US005301473A

United States Patent [19]

Seear

[11] Patent Number: 5,301,473

[45] Date of Patent: Apr. 12, 1994

[54] GRINDING APPARATUS COMPRISING A TOOL HOLDING JIG

[76] Inventor: David Seear, "Woodclear", 175 Oatlands Dr., Weybridge, Surrey KT13 9JY, United Kingdom

[21] Appl. No.: 809,479

[22] PCT Filed: May 4, 1990

[86] PCT No.: PCT/GB90/00704

§ 371 Date: Jan. 8, 1992

§ 102(e) Date: Jan. 8, 1992

[87] PCT Pub. No.: WO90/13396

PCT Pub. Date: Nov. 15, 1990

[30] Foreign Application Priority Data

May 9, 1989 [GB] United Kingdom ..... 8910640

[51] Int. Cl.[5] ..... B24B 41/06

[52] U.S. Cl. ..... 51/217 R; 51/46; 51/115; 51/91 R; 51/218 R; 51/216 R

[58] Field of Search ..... 51/173, 216 R, 217 R, 51/217 A, 218 R, 218 A, 139 SR, 217 S, 216 A, 2 G, 2 H, 2 J, 44, 46, 47, 64, 65, 83 R, 83 BS, 85 R, 85 BS, 86 R, 86 BS, 91 R, 115, 116, 124 R

[56] References Cited

U.S. PATENT DOCUMENTS

| | | | |
|---|---|---|---|
| 1,440,386 | 1/1923 | Hawes | 71/19 |
| 3,440,772 | 4/1969 | Wright | 51/170 R |
| 3,881,889 | 5/1975 | Hunkeler | 51/288 |
| 4,736,544 | 4/1988 | Greenquist | 51/217 A |

FOREIGN PATENT DOCUMENTS

| | | |
|---|---|---|
| 0286266 | 10/1988 | European Pat. Off. . |
| 8600115 | 8/1987 | Netherlands . |
| 378162 | 8/1932 | United Kingdom . |

*Primary Examiner*—Bruce M. Kisliuk
*Assistant Examiner*—Eileen P. Morgan
*Attorney, Agent, or Firm*—Renner, Otto, Boisselle & Sklar

[57] ABSTRACT

A tool holding jig for a grinding machine has a tool holder 29 mounted on a parallelogram linkage having lower swivel rods 19 inclined slightly so that, as the tool holder 29 is rocked to and fro across the face 31 of a grinding wheel by a reciprocating drive arm 53, the grinding pressure is greatest at the center of the rocking motion.

14 Claims, 7 Drawing Sheets

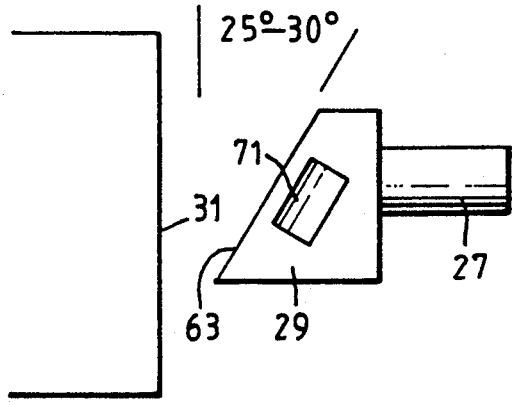
FIG. 4
FIG. 5
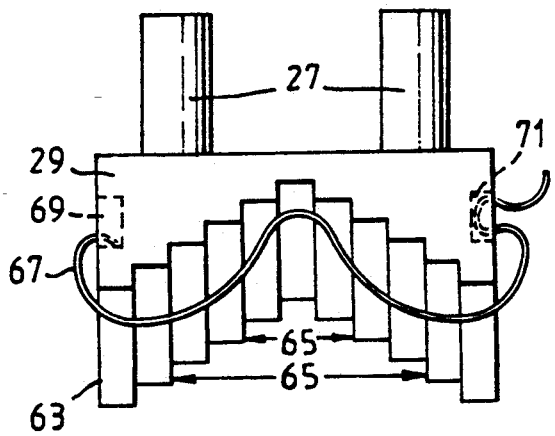
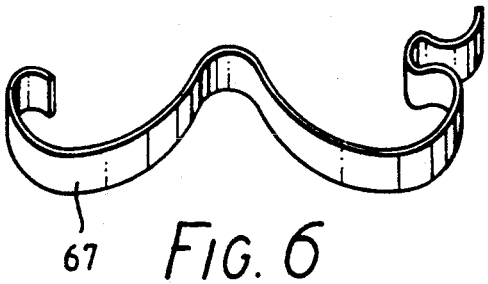
FIG. 6
FIG. 7
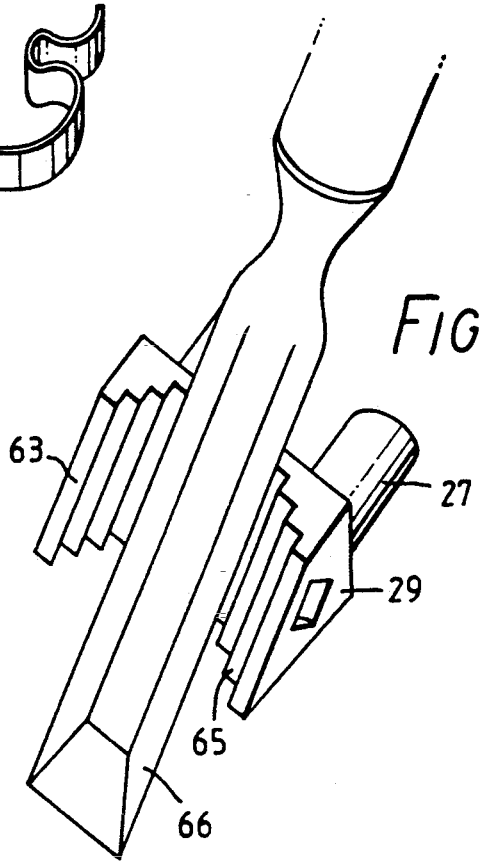

GRINDING APPARATUS COMPRISING A TOOL HOLDING JIG

This invention relates to grinding apparatus, particularly though not exclusively for hand tools and blades therefor, e.g. chisels, screwdrivers and plane blades, and more specifically relates to a tool holding jig for a grinding machine.

BACKGROUND OF THE INVENTION

Hand tools such as chisels are conventionally given a good cutting edge by hand-honing on an oil-stone. However from time to time more radical grinding is necessary e.g. to remove nicks in the sharpened edge and to re-establish the conventional 25° angle between the two faces at the edge. This can be done by using a surface grinder with a cup-shaped grinding wheel and a carriage for holding the hand tool which is reciprocated to and fro across the axial annular working face of the grinding wheel by a chain e.g. for a distance of two feet. Such surface grinders are expensive and non-portable (they have cast iron beds) and they can take a long time to remove perhaps 1-2 thou (25 to 50 micrometers) from the sharpened edge due to the length of travel. Alternatively a portable grinder with a standard disc grinding wheel can also be used but such a grinder is not provided with a carriage and the operator has to be skilled if he is to provide a straight sharpened edge in the minimum time without overheating the steel so that its temper is lost.

There is therefore a need for a relatively inexpensive adapter apparatus for a bench grinder which will permit safe, rapid, accurate, automatic grinding of a tool or blade near where it is being used rather than in an engineering workshop.

A tool holding jig is known from GB 378162 for use when grinding chisels and plane blades. This jig comprises a pair of linkages arranged in a parallelogram configuration by each having one end universally pivotally mounted on a base of a grinding machine and by each having near its other end a uniaxially pivotal connection to a tool holding member onto which a tool can be clamped. In use, the tool is rocked to and fro across the grindstone manually using handles at said other ends of the linkages. A problem with this known jig is that the angle to which the tool is ground is dependent on the position in which the tool is clamped to the holding member, and thus care needs to be taken when mounting the tool in the holding member to ensure the correct angle will be achieved. A further problem with this known jig is that the type of pivotal connections which are shown and described will enable the parallelogram configuration to skew so that the difficulty will be caused when attempting to grind a straight square edge.

SUMMARY OF THE INVENTION

The present invention is characterised in that parallelogram linkages are mounted on the grinding machine by respective substantially parallel swivel rods for uniaxial pivoting about the axes of the rods. Thus, the angle of the plane of the parallelogram structure is predetermined. Furthermore, a parallelogram structure which is more resistant to skewing out of its own plane can be provided.

Preferably, the plane in which the tip of the tool rocks is arranged to be inclined, for example at an angle of 2°±1°, to the end face of the grinding wheel so that the tip is at its most forward position when it is in the central region of its rocking motion. Thus when the edge being sharpened is in its central position with respect to the grinding face it is pressed with a maximum pressure against this face and when it moves away from this central position, the pressure decreases. This compensates for the tendency to form a convex edge which arises because of the increased grinding rate when only part of the length of the edge is being pressed against the grinding face.

While hand rocking of the holder is envisaged, it is preferred that the apparatus comprises drive means connecting a shaft driving the grinding wheel to the holder e.g. via speed reduction means and a crank or eccentric. The speed reduction means desirably comprises an initial belt drive followed by a gear train. If the belt drive permits for example a speed reduction from 3000 to 1000 r.p.m., the gear train can be of relatively cheap plastics spur gears which run without cooling lubricants and can further reduce the crank speed.

BRIEF DESCRIPTION OF THE DRAWINGS

An embodiment of the invention will now be described by way of example with reference to the accompanying diagrammatic drawings in which:

FIG. 4 shows a side elevation of the holder of the FIG. 2 embodiment and its angle relative to the grinding face;

FIG. 5 shows a plan view of the holder of FIG. 4 with a retaining clip in position;

FIG. 6 is a detail view of the retaining clip of FIG. 5;

FIG. 7 is a general view showing a chisel mounted in the holder;

DETAILED DESCRIPTION

Figure 8:
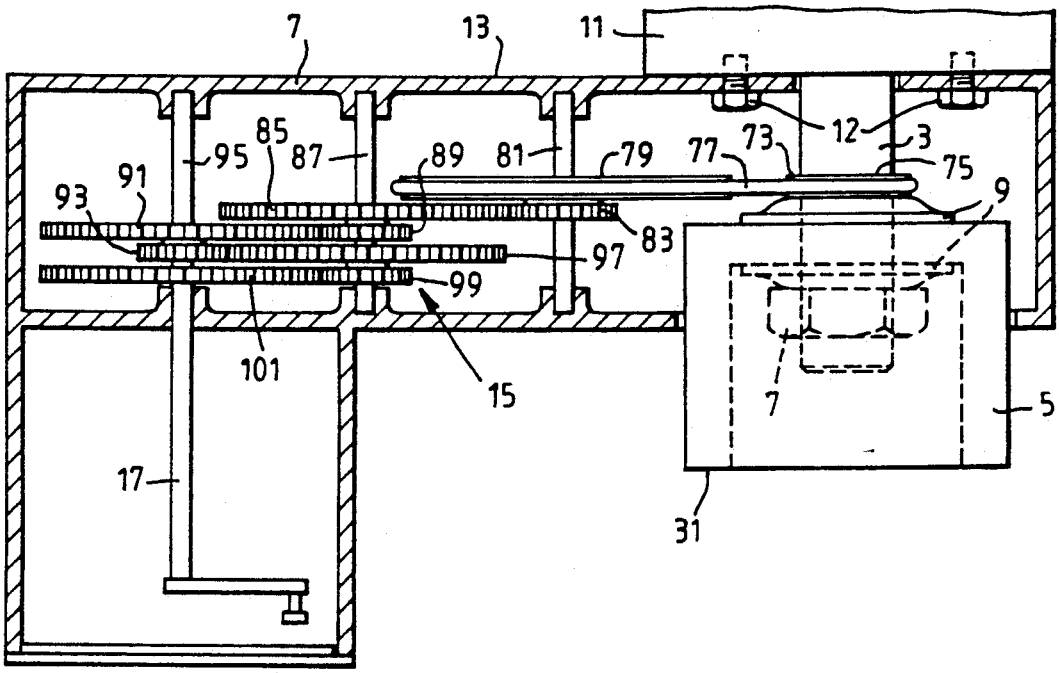
FIG. 8 is a plan view of the drive means of the FIG. 2 embodiment.
Figure 9:
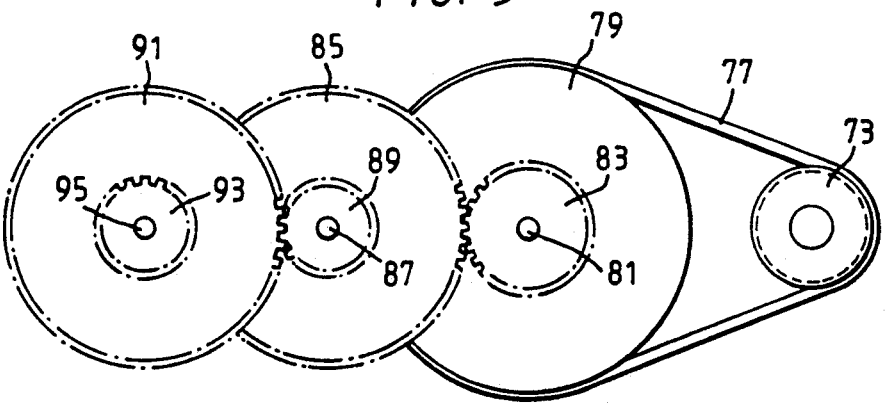
FIG. 9 is a front elevation of the first five spur gears of the spur gear train.

A conventional portable bench grinding machine 1 has an electric drive motor 2, a main shaft 3 and a 3 inch diameter cup grinding wheel 5 retained on the end of the shaft 3 by a nut 7 and washers 9 in conventional manner (see FIG. 8); this cup grinding wheel replaces one of the standard 6 inch disc grinding wheels with which the bench grinding machine is normally supplied. Bolted to the housing 11 of the machine by studs 12 using the bolt holes normally used for fixing the guard is a gearbox housing 13 which contains a reduction drive 15 described in more detail below. This reduces the speed of the main shaft 3 which is about 3000 r.p.m. to the speed of the drive shaft 17 which is about 20–40 r.p.m., preferably about 40 r.p.m.

Figure 1:
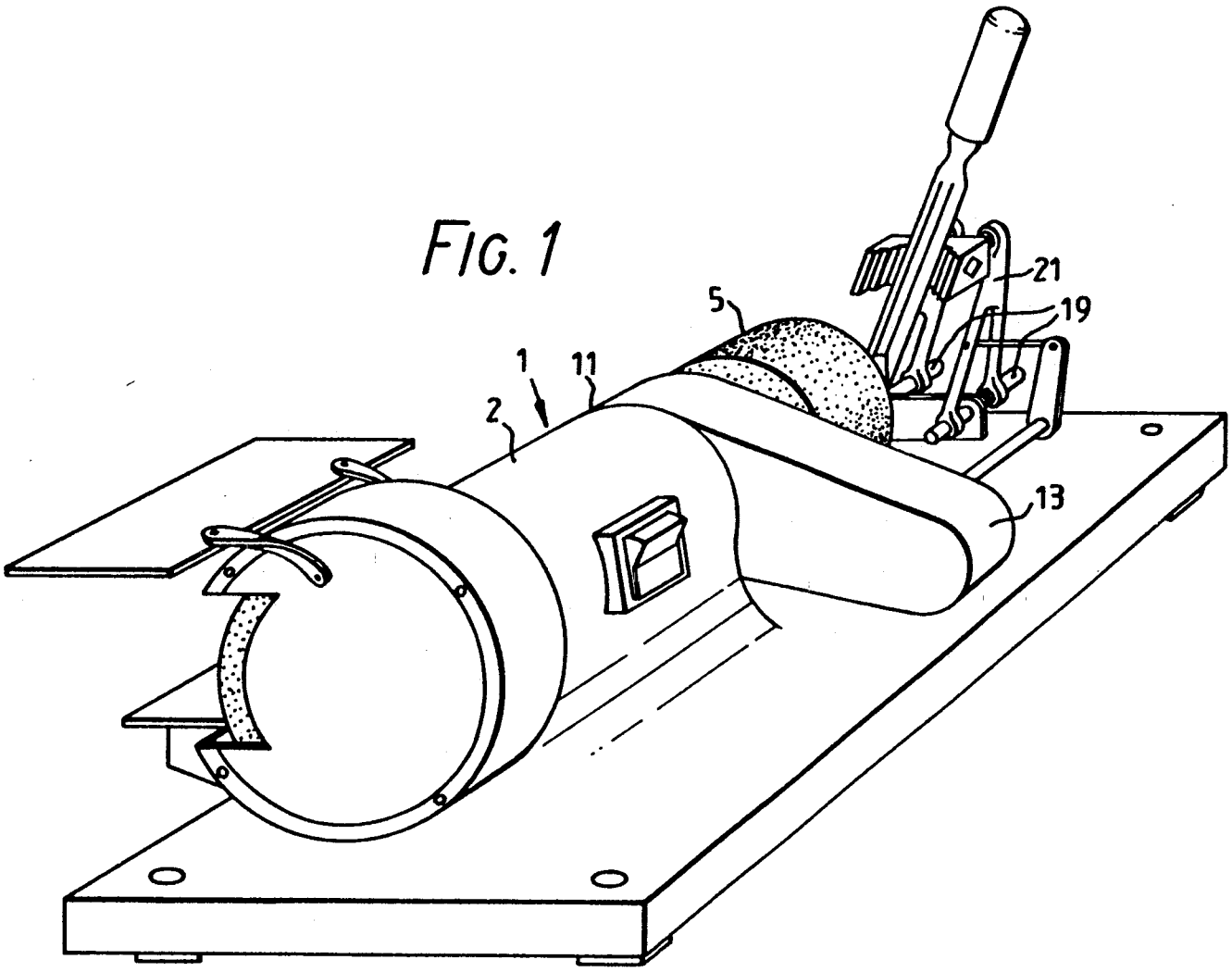
FIG. 1 is a perspective view of a bench grinding machine provided with apparatus according to the invention.
Figure 2:
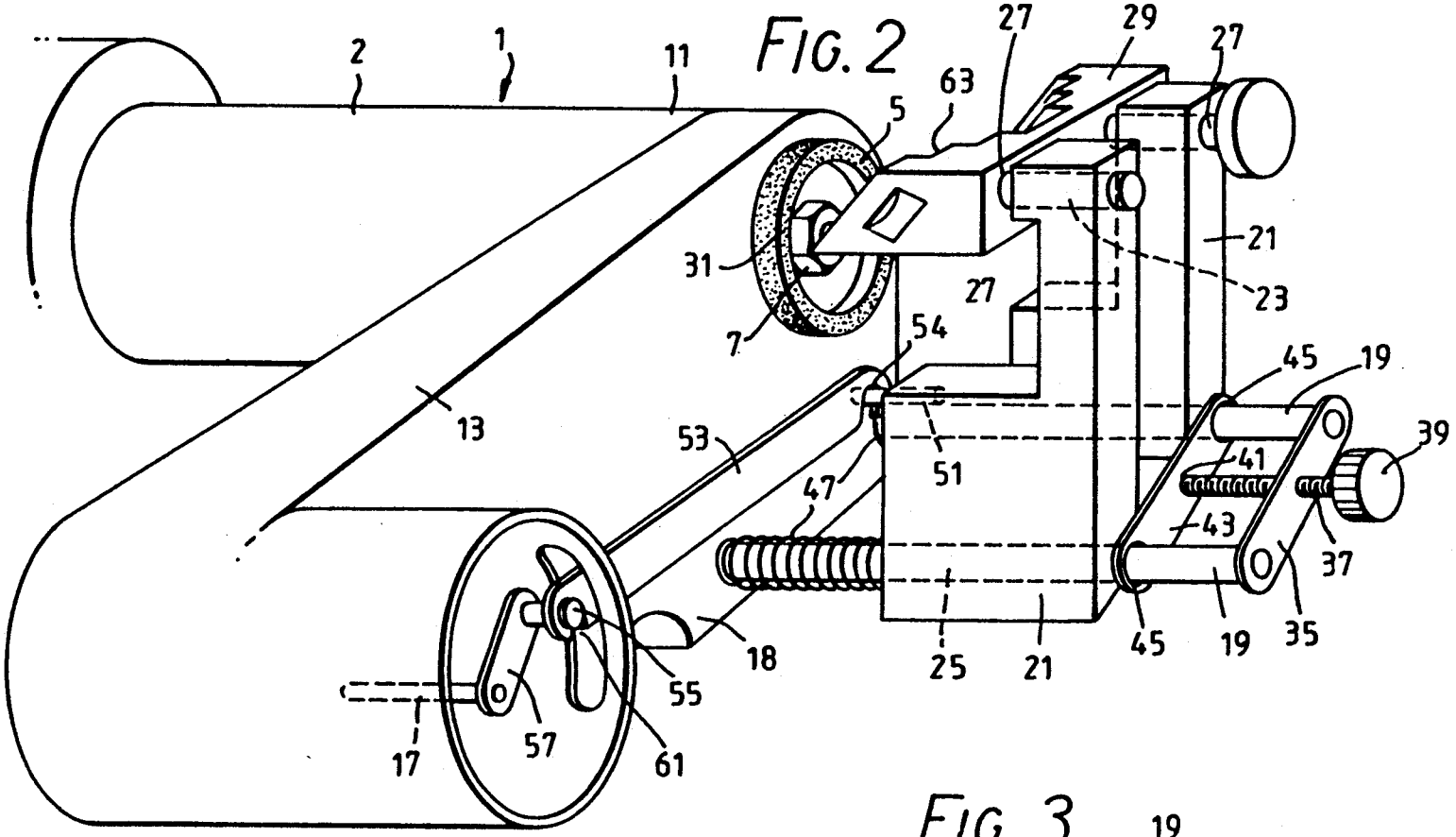
FIG. 2 is a more detailed view of one end of a slightly modified version of the machine of FIG. 1.
Figure 3:
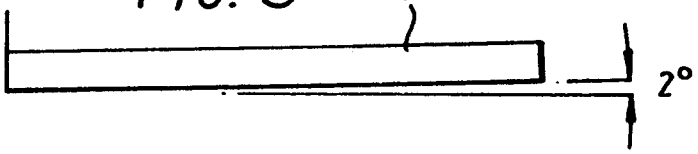
FIG. 3 shows a swivel rod of the FIG. 2 embodiment and its angle of tilt relative to the grinding face.

Also, bolted or otherwise fixed to the gearbox housing 13 (or alternatively to the bench on which the grinding machine is mounted) is a mounting plate 18 carrying two parallel lower swivel rods 19 which are upwardly inclined at an angle of about 2° as shown in FIG. 3. Pivotally mounted on each rod 19 is a carriage member 21, the carriage members 21 having through holes 23 at their upper ends which are parallel to the holes 25 at their lower ends through which the lower swivel rods 19 pass. The holes 23 respectively receive upper swivel rods 27 which extend rearwardly from a holder 29 which is thus mounted by a parallelogram linkage for movement in a plane tilted at 2° with respect to the vertical and thus to the opposite working face 31 of the grinding wheel 5 which is truly vertical. The holder 29 in its top dead centre position is symmetrically disposed relative to the face 31. One of the upper swivel rods 27 is provided with a knob 33 at its rear end which permits manual rocking of the holder 29.

Screwed to and joining the free ends of the lower swivel rods 19 is a plate 35 with a central tapped bore through which passes an adjusting screw 37 with a knob 39 at its outer end. At its inner end 41 it bears against an adjustment plate 43 having holes 45 by means of which it is slidable on the rods 19. The plate 43 provides an abutment for the carriage members 21, the members 21 being resiliently biassed against the plate 43 by helical compression springs 47 on the rods 19.

One of the carriage members 21 has a headed drive pin 51 connected by a connecting rod 53 to a crank pin 55 on a crank arm 57 carried by drive shaft 17. The connecting rod 53 is in the form of a flat bar having respective slots 59, 61 which permit it to engage with pins 51, 55 while at the same time making it easy to lift off when the holder 29 is to be moved manually.

The holder 29 comprises a front face 63 sloping at the required grinding angle; this angle will normally be 25°–30° (chisel blades are normally produced with a 25° taper but hand sharpening increases this taper to up to 30°). The front face 63 is progressively more deeply recessed in a stepwise manner from the outside to the inside. The sloping recesses 65 so formed are of varying widths to snugly receive various widths of tools and tool blades (see chisel blade 66 in FIG. 7). The tools and tool blades are held in the appropriate recess 65 by a W-shaped spring steel retaining clip 67 shown in FIGS. 5 and 6, the extremities of the clip 67 being lodged in recesses 69, 71 of the holder as shown in FIG. 5.

The reduction drive 15 comprises a pulley 73 clamped against a shoulder 75 on the main shaft 3 by the inner of the two washers 9 under the compression force of the nut 7. A belt 77 e.g. of coiled steel spring connects the pulley 73 to a larger pulley 79 on a first gear shaft 81 in the auxiliary housing 13. The pulley 79 is coupled to a spur gear 83 on shaft 81 which takes the drive to a spur gear 85 on a second gear shaft 87, the spur gear 85 being coupled to a spur gear 89 but the gears 85, 89 being freely rotatable on the shaft 87 but axially fixed thereon. The drive then passes to a similar pair of spur gears 91, 93 on a third gear shaft 95 and thence back to a further pair of spur gears 97, 99 on the shaft 87. Finally the drive passes to a spur gear 101 keyed on the drive shaft 17. The gears are conveniently of plastics material and may be located axially by sleeves (not shown). The whole gear train is designed to run without the use of cooling lubricants.

In operation, the adjusting screw 37 is first screwed out to facilitate mounting a chisel or other blade 66 in the holder 29 and after mounting the blade in the appropriate recess 65 (FIG. 7) it is retained by placing one end of the clip 67 in recess 69 and flexing the other end so that it snaps into recess 71. The motor 2 is started and the adjusting screw 37 is then screwed in with the holder 29 at its central position until the blade 66 abuts the grinding face 31 with the desired pressure (contact plus a quarter turn with the preferred arrangement). The blade 66 is then rocked by hand to test the grinding. If satisfactory the connecting rod 53 is lowered into position and the blade 66 is thus automatically rocked to and fro across the grinding face 31 until grinding is completed. Once set up, attendance by an operator is generally not necessary unless more than approx. 10 thou are to be ground away.

When a 2 inch plane blade 66 (the largest blade envisaged with this embodiment) is being ground, the rocking movement is such that the blade 66 clears the face 31 at each end of its movement to permit cooling for about 0.5 sec. Satisfactory grinding of such a plane blade can be achieved in about 2 minutes. With narrow chisel blades, grinding is more rapid and a grinding time of as little as 1 minute can be effective for removing 10 thou (the average amount removed before the apparatus has to be reset). On the other hand grinding times of 5 or 6 minutes (with appropriate resetting) may be necessary for badly notched blades.

The speed of shaft 17 may be adjusted to give an appropriate number of rocking movements across the face 31 by changing gears in the gearbox. Normally the shaft speed is in the range 20–40 r.p.m. (40–80 grinding contacts per minute) with 20–30 r.p.m. being preferred. With a narrower blade, the shaft speed can be increased as the blade spends more time out of contact with the face 31.

It will be seen that the tilting of the parallelogram linkage serves to pull the blade 66 back from contact with the part of the grinding wheel 5 which is diametrically opposite the working part of the face 31.

It will be seen that it is a relatively simple matter to adapt a standard portable bench grinding machine by bolting on a gearbox housing according to the invention with its associated swivel rods and holder. The pulley 73 is also simple to mount on the main shaft 3 by removal of the grinding wheel 5 placing the pulley 73 on the shaft and replacing the grinding wheel 5.

Figure 10:
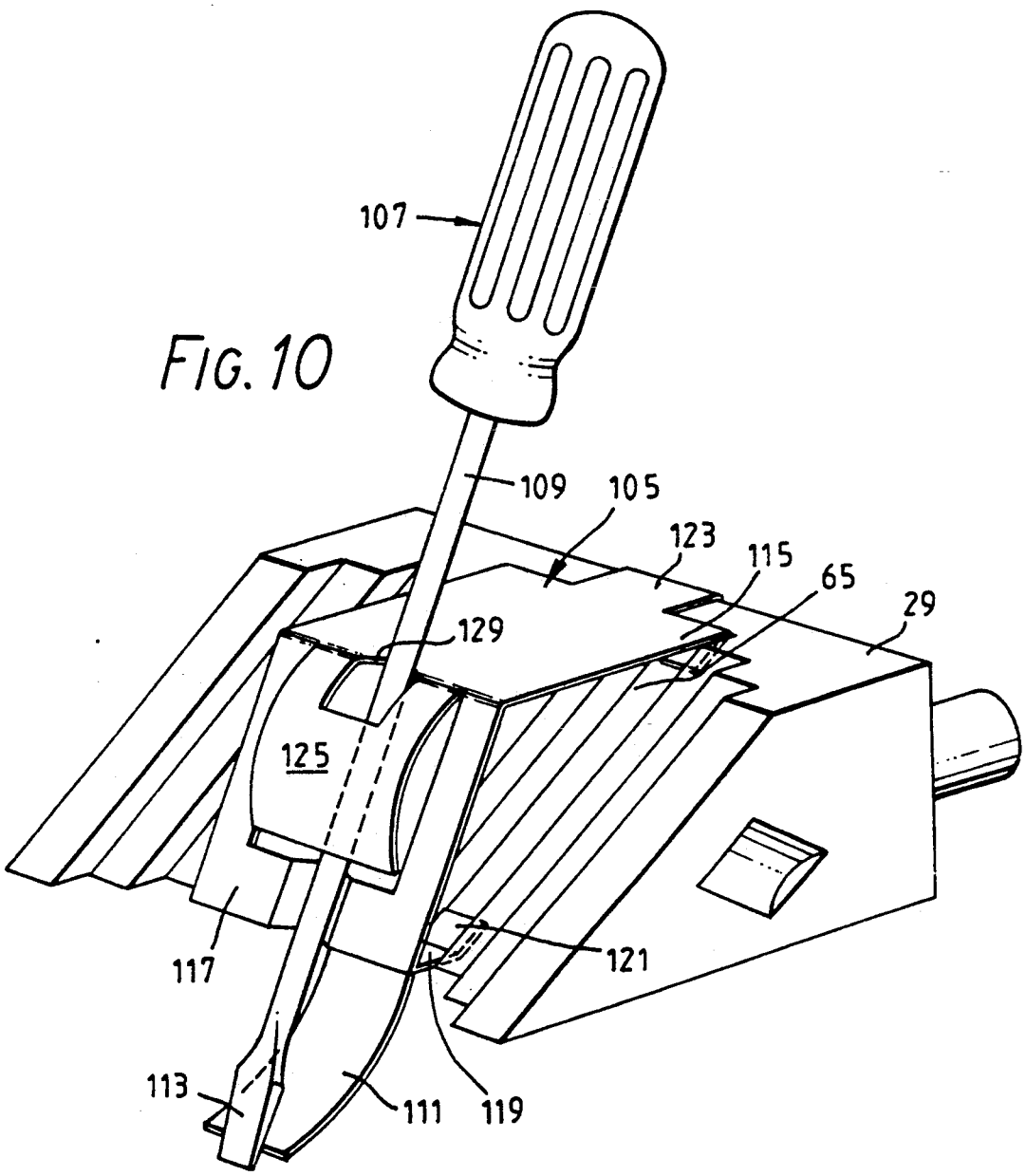
FIG. 10 shows a screwdriver adapter with a screwdriver therein, mounted on the holder.
Figure 11:
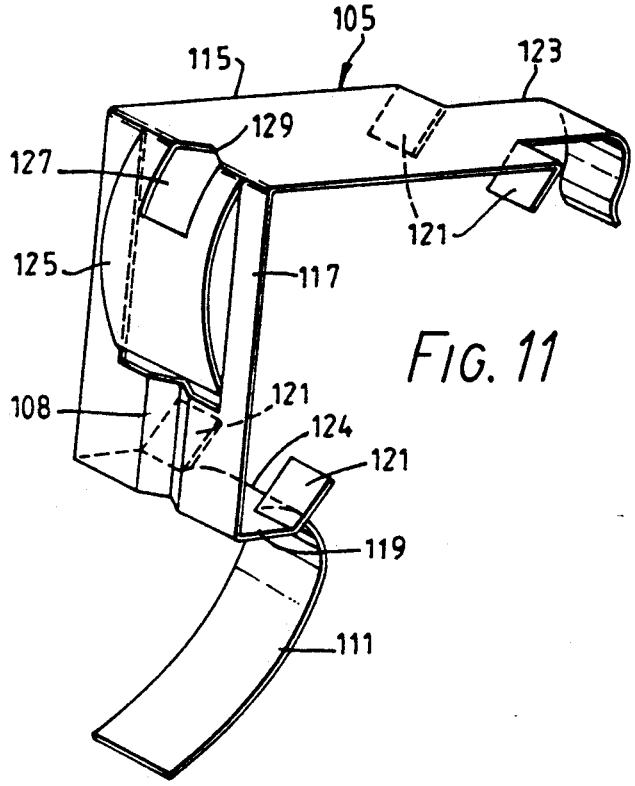
FIG. 11 is a more detailed view of the clip shown in FIG. 10.
Figure 12:
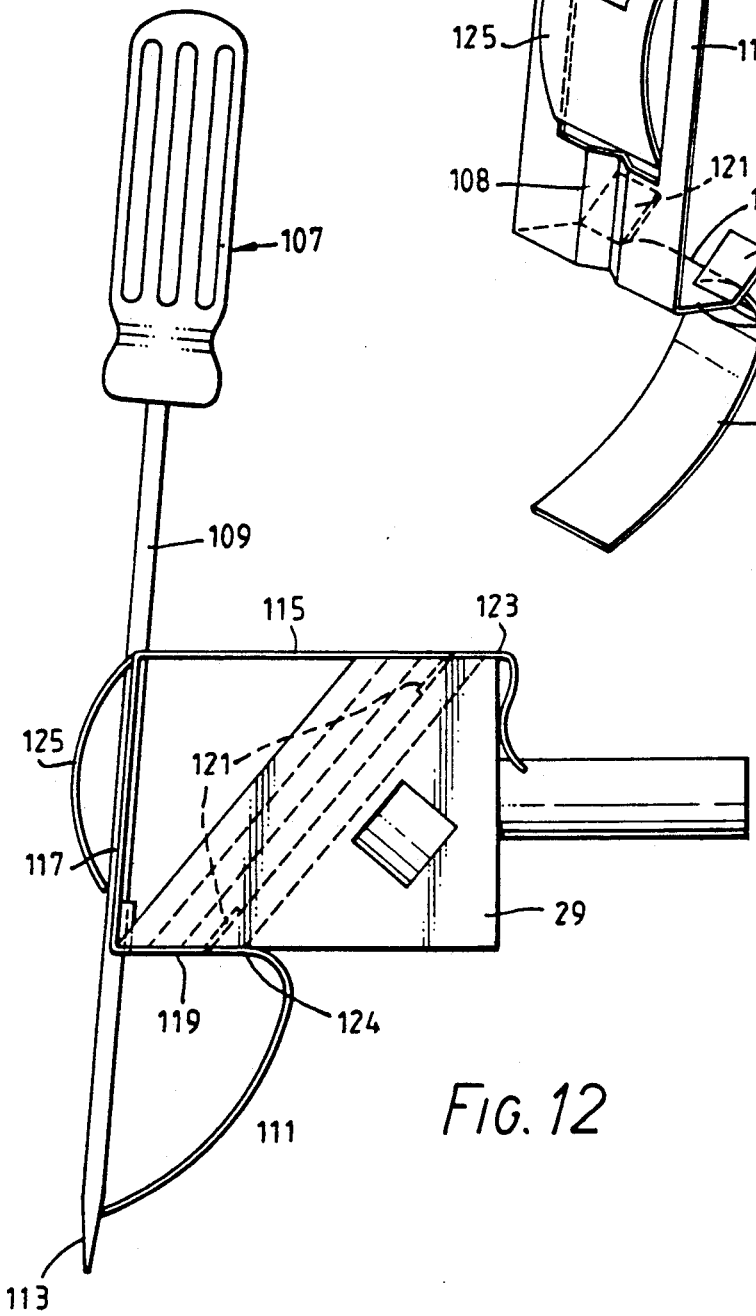
FIG. 12 is a side elevation corresponding to FIG. 12.

FIGS. 10–12 show an adapter 105 for a screwdriver 107. The adapter 105 is lodged in a recess 65 and has a groove 108 for the screwdriver shaft 109. The adapter 105 has a depending toe 111 against which the flat part 113 of the shaft 109 rests at a predetermined angle (usually 2°) to the vertical so that the shaft does not twist about its own axis and more importantly so that the flat part 113 is exactly square to the grinding wheel. Otherwise grinding the screwdriver 107 is similar to sharpening a chisel blade 66 except of course that flat part 113 is ground twice, once on each side. The toe 111 ensures that grinding takes place on parallel surfaces on each side of the flat part 113 so that there is no taper in a horizontal plane.

More in detail the adapter 105 is formed from spring steel strip to provide a horizontal upper portion 115, a vertical intermediate portion 117 and a horizontal lower portion 119 which is shorter than upper portion 115.

The extremities of horizontal portions 115, 119 each have a pair of angled lugs 121 which snugly fit into the recess 65 and locate the adapter 105 horizontally. It is located vertically and held in position by a clip extension 123 which rests on the holder 29 and resiliently bears on its rear face, an extension 124 of portion 119 extending beneath holder 29 to prevent upward movement. A further clip 125 is punched out of the vertical portion 117 and is in the form of an arcuate member connected to the remainder of the adapter at the top where it has a central opening 127 for receiving the shaft 109. As shown in FIG. 11 the portion 115 adjacent opening 127 has a V-shaped notch 129 and an aligned V-shaped groove 108 is provided at the lower end of the portion 115. The notch 129 and groove 108 serve to locate the shaft 109 which is resiliently held therein by the lower end of clip 125.

Figure 13:
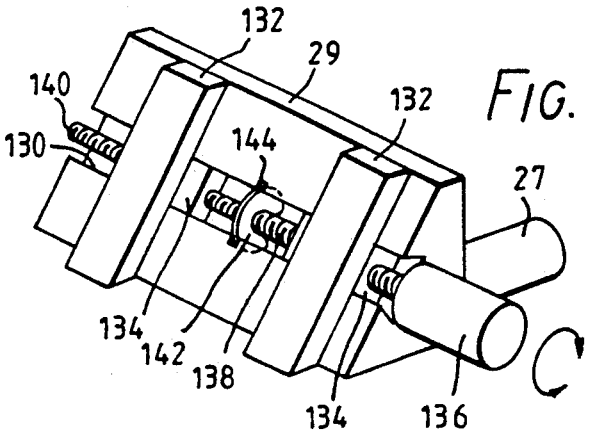
FIG. 13 is a perspective view of a modified tool holder.

FIG. 13 shows a modified tool holder 29 having swivel rods 27, and with a generally planar inclined front face, rather than a stepped face as previously specifically described. However, the front face has a wedge-shaped slot 130 extending horizontally across it, and a pair of jaws 132 have wedge-shaped projections 134 which lock into and run along the slot 130. A horizontal screw has an adjustment knob 136 at one end, a 5 mm diameter threaded portion 138 over half of its length, and a 4 mm diameter threaded portion 140 of the same pitch over the other half of its length. These threaded portions engage threaded holes in the projections of the respective jaws 132. A spring clip 142 internally engages a groove in the screw between the two different thread forms and externally engages a groove 144 in the holder 29, thus maintaining the axial position of the screw. Accordingly, this arrangement is like a tool-makers clamp and is used to clamp a chisel or plane blade flat against the inclined front face and between the jaws 132.

Figure 14:
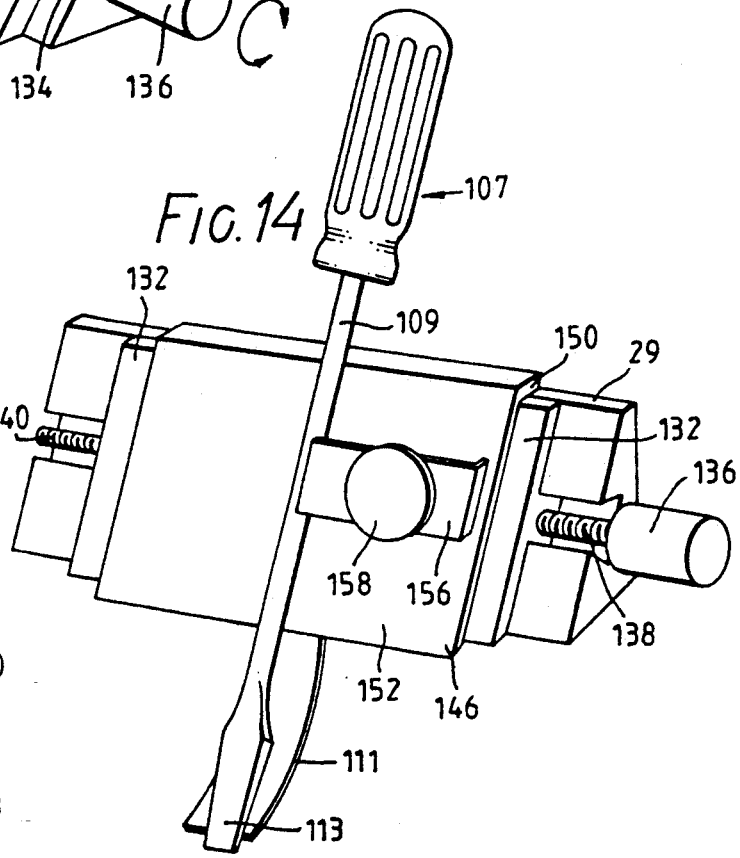
FIG. 14 is a perspective view of the tool holder of FIG. 13 and a modified screwdriver adapter.
Figure 15:
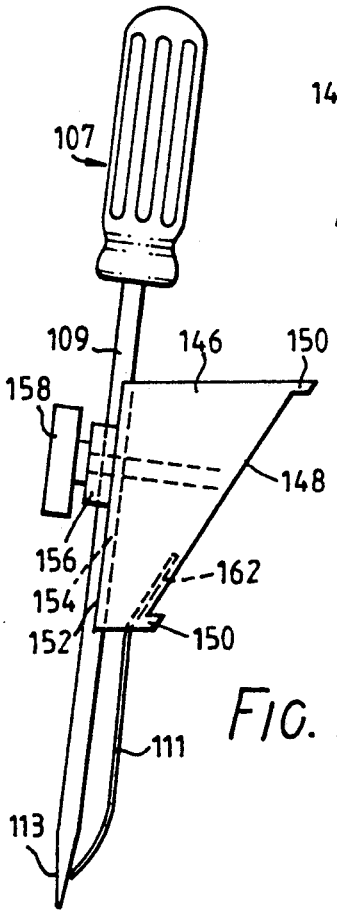
FIG. 15 is a side view of the screwdriver adapter of FIG. 14.

FIGS. 14 and 15 illustrate a modified screwdriver adapter for use with the tool holder 29 of FIG. 13. The adapter comprises a block 146 having a rear face 148 which has upper and lower locating lugs 150 and which can be clamped between the jaws 132 with the rear face 148 flat against the front face of the tool holder. The front face 152 of the adapter is inclined relative to the rear face and has a central groove 154 to receive the shaft 109 of the screwdriver 107. A retaining plate 156 is attachable to the front face 152 of the adapter 146 by a thumb screw 158 and at least partly overlies the screwdriver shaft 109 so as to hold it in place. An alignment spring 111 has its upper end 162 rigidly embedded in the block 146 and extends downwardly to engage a flat of the screwdriver blade 113 to assist in ensuring that the blade is correctly aligned.

What is claimed is:

1. A tool holding jig for a grinding machine, comprising:

a holder for holding a tool blade;

first and second pivot members mountable on or adjacent the grinding machine; and first and second linkages each having a first end and a second end, the first ends of the first and second linkages being pivotally connected to the first and second pivot members, respectively, and the second ends of the first and second linkages being pivotally connected to the tool holder in a parallelogram configuration, so that with pivoting of the parallelogram arrangement the tool blade can be rocked to and fro across a face of a grinding wheel mounted for rotation by the grinding machine;

the pivot members being provided by first and second substantially parallel swivel rods, and the linkages being mounted for uniaxial pivoting about the axes of the respective swivel rods.

2. A jig according to claim 1, wherein the plane in which the tip of the tool rocks is arranged to be inclined to the plane in which an end face of the grinding wheel rotates such that the tip is at its most forward position when it is in the central region of its rocking motion.

3. A jig according to claim 2, wherein the inclination is $2° \pm 1°$.

4. A jig according to claim 1, further including an adjusting screw means for moving the linkages longitudinally along the swivel rods.

5. A jig according to claim 4, wherein helical springs are provided on the swivel rods for urging the linkages against the adjusting screw means, the adjusting screw means including an abutment member or members slidable on the swivel rods.

6. A jig according to claim 1, further including a speed reduction means for connection to a shaft of the grinding machine and a crank or eccentric arranged to be driven by the speed reduction means and connectable to the holder to provide an automatic rocking motion.

7. A jig according to claim 6, wherein the speed reduction means includes an initial belt drive.

8. A jig according to claim 6, wherein the speed reduction means includes plastics gears.

9. A jig according to claim 1, wherein the holder has a stepped front face permitting it to receive tools and tool blades of various widths at the appropriate inclination for grinding.

10. A jig according to claim 9, wherein a spring clip is provided for holding a tool or tool blade in the stepped front face of the holder.

11. A jig according to claim 9, which includes an adapter snap fittable to the holder so that it fits within one of the steps and provided with groove means for receiving a screwdriver shaft and means for holding the shaft in the groove means.

12. A jig according to claim 11, wherein the adapter has a toe for engaging the back of the flattened part of the screwdriver shaft.

13. A jig as claimed in claim 1, wherein the holder has a front face on which to receive a tool at the appropriate inclination for grinding and jaws having a spacing which can be adjusted to claim the tool to the holder.

14. A grinding apparatus comprising a grinding machine and a tool holding jig wherein the grinding machine comprises a grinding wheel having a face, and means for rotating the grinding wheel, and wherein the tool holding jig comprises a holder for holding a tool blade; first and second pivot members mounted on or adjacent the grinding machine; first and second linkages each having a first end and a second end, the first ends of the first and second linkages being pivotally connected to the first and second pivot members, respectively, and the second ends of the first and second linkages being pivotally connected to the tool holder in a parallelogram configuration, so that with pivoting of the parallelogram arrangement the tool blade can be rocked to and fro across the face of the grinding wheel; the pivot members being provided by first and second substantially parallel swivel rods, and the linkages being mounted for uniaxial pivoting about the axes of the respective swivel rods.

* * * * *